US008459824B1

(12) United States Patent
Esmailzadeh et al.

(10) Patent No.: US 8,459,824 B1
(45) Date of Patent: Jun. 11, 2013

(54) LIGHTING FIXTURE

(76) Inventors: Ashkan Esmailzadeh, Los Angeles, CA (US); Arash Esmailzadeh, Los Angeles, CA (US)

( * ) Notice: Subject to any disclaimer, the term of this patent is extended or adjusted under 35 U.S.C. 154(b) by 216 days.

(21) Appl. No.: 12/592,711

(22) Filed: Dec. 1, 2009

(51) Int. Cl.
*F21S 8/00* (2006.01)
*F21V 29/00* (2006.01)

(52) U.S. Cl.
USPC ..... 362/147; 362/218; 362/294; 362/373; 362/241; 362/249.02

(58) Field of Classification Search
USPC ..... 362/218, 294, 373, 241, 249.02, 362/249.04, 147
See application file for complete search history.

(56) References Cited

U.S. PATENT DOCUMENTS

| | | | | |
|---|---|---|---|---|
| 5,806,965 | A * | 9/1998 | Deese | 362/249.04 |
| 7,566,154 | B2 * | 7/2009 | Gloisten et al. | 362/545 |
| 7,645,052 | B2 * | 1/2010 | Villard | 362/147 |
| 2003/0081419 | A1 * | 5/2003 | Jacob et al. | 362/364 |

* cited by examiner

*Primary Examiner* — Stepehen F Husar
*Assistant Examiner* — James Cranson, Jr.
(74) *Attorney, Agent, or Firm* — Don Finkelstein

(57) ABSTRACT

A ceiling mounted lighting fixture for insertion in a ceiling grid wherein the source of artificial light is a plurality of light emitting diodes.

34 Claims, 14 Drawing Sheets

LIGHTING FIXTURE

BACKGROUND OF THE INVENTION

1. Field of the Invention

This invention relates to the artificial lighting field and more particularly to a ceiling mounted lighting fixture adapted to mount in a standard ceiling grid and utilizing LED as the source of the artificial lights.

2. Description of the Prior Art

Many types of lighting fixtures adapted to be mounted on ceilings of residential, commercial and industrial facilities have been utilized in the past. Such lighting fixtures have included hanging chandeliers, fixtures attached to the ceiling, track lights and the like. Incandescent bulbs or fluorescent bulbs have generally been utilized in such fixtures to provide the source of the artificial light.

Many ceilings in residential, commercial and industrial type buildings have included ceiling tiles of various materials and configurations. The tiles were generally arrayed in a standardized rectilinear matrix or grid often in a T bar grid having basic dimensions spaced to be a 24 inch by 24 inch grid. The tiles were supported on multiple interconnected T bar cross members, generally fabricated from metal, which had outwardly extending flanges for supporting the tiles. Lighting fixtures such a fluorescent bulb lighting fixtures were often fabricated in dimensions matching one or a multiple of the grid spacing, such as 24 inch by 24 inch, 48 inch by 24 inch or the like to replace one or more of the tiles thereby allowing installation of the fixture in the ceiling in any desired array within the grid and supported in part on the cross members. As a result, such fluorescent fixtures including the reflectors, casing and associated hardware necessary for operation were often bulky and costly to manufacture, store and ship. Additionally, while the fluorescent bulbs utilized less electrical energy than incandescent bulbs for equivalent light output, the demands for even greater conservation of energy have indicated that it is desirable to provide an artificial light output that utilizes even less energy than fluorescent bulbs for the same or nearly the same light output and that requires less space for mounting in a standard T bar grid array. Additionally, it is desired to provide a lighting system that requires less maintenance due to a longer lamp live and requiring less labor for installation.

Thus, there has been a need for compact artificial lighting fixture that is adaptable for installation as a standardized T bar ceiling grid without major modifications to the grid and that minimizes the amount of electrical energy utilized for light outputs equivalent to the light output of incandescent bulbs or fluorescent bulbs.

Accordingly, it is an object of the present invention to provide a compact source of artificial light output.

It is another object of the present invention to provide compact source of artificial light output that may be installed as a standardized T bar ceiling grid with minimum modifications to the grid.

It is another object of the present invention to provide a compact source of artificial light output that may be installed as a standardized T bar ceiling grid with minimum modifications to the grid and which minimizes the electrical energy utilized to produce the light output.

SUMMARY OF THE INVENTION

The above and other objects of the present invention are achieved, in a preferred embodiment thereof by providing a light fixture for providing artificial light. The light fixture has a generally hat shaped mounting bracket having a top portion, a pair of opposed side portions depending from the top portion and outwardly extending flange portions connected to the side portions and spaced from the top portion. The top portion has an inside surface which faces the area to be illuminated and an outside surface which faces into the area above the ceiling.

A plurality of light emitting diodes (LED) are connected in parallel and mounted on the inside surface of the top portion of the hat shaped bracket. The LED may be in a linear array or any other array as desired for particular applications.

One or more cooling fins are coupled to the outside surface of the top portion of the hat shaped bracket, or in some embodiments, from the side portions, and extend away therefrom to provide for heat dissipation from the operation of the LED's and/or for connection to additional supporting structure which may be required in some applications.

Conventional electrical wires and electrical connectors are provided to supply the electrical energy to the LED. Ceiling tiles may be supported on the outwardly extending flanges so that the lighting fixture of the present invention may be installed into either a T bar grid of a new ceiling construction or retrofitted into the T bar grid of old ceiling structures. A reflector member may be installed adjacent the inside surface of the top portion of the hat shaped mounting bracket to direct the light from the LED's toward the area to be illuminated.

BRIEF DESCRIPTION OF THE DRAWING

The above and other embodiments of the present invention may be more fully understood from the following detailed description taken together with the accompanying drawing wherein similar reference characters refer to similar elements throughout and in which.

DESCRIPTION OF THE PREFERRED EMBODIMENTS

Figure 1:
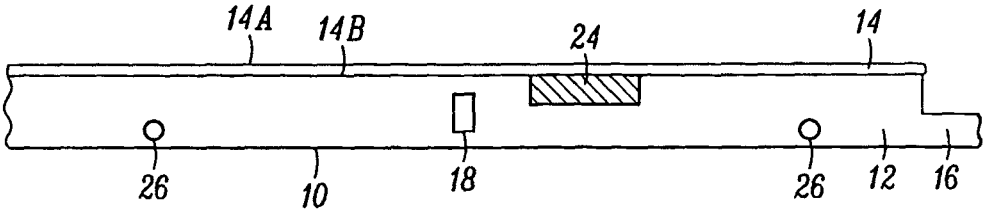
FIGS. 1 and 2 illustrate a conventional T bar grid cross member of the type forming a grid array into which the lighting fixture of the present invention may be installed.
Figure 2:
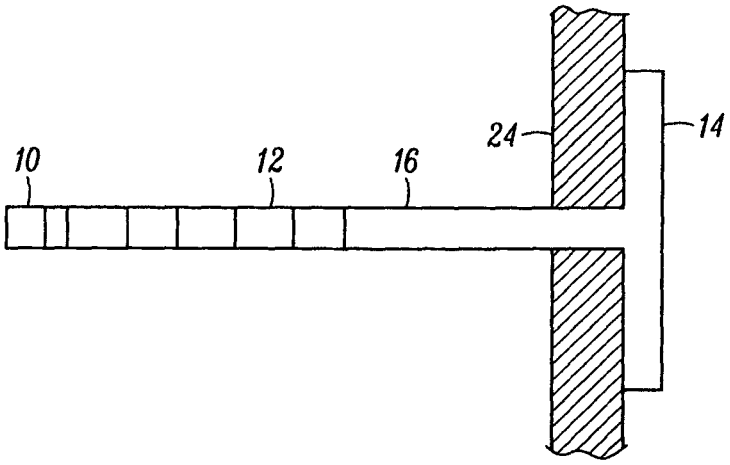
Figure 3:
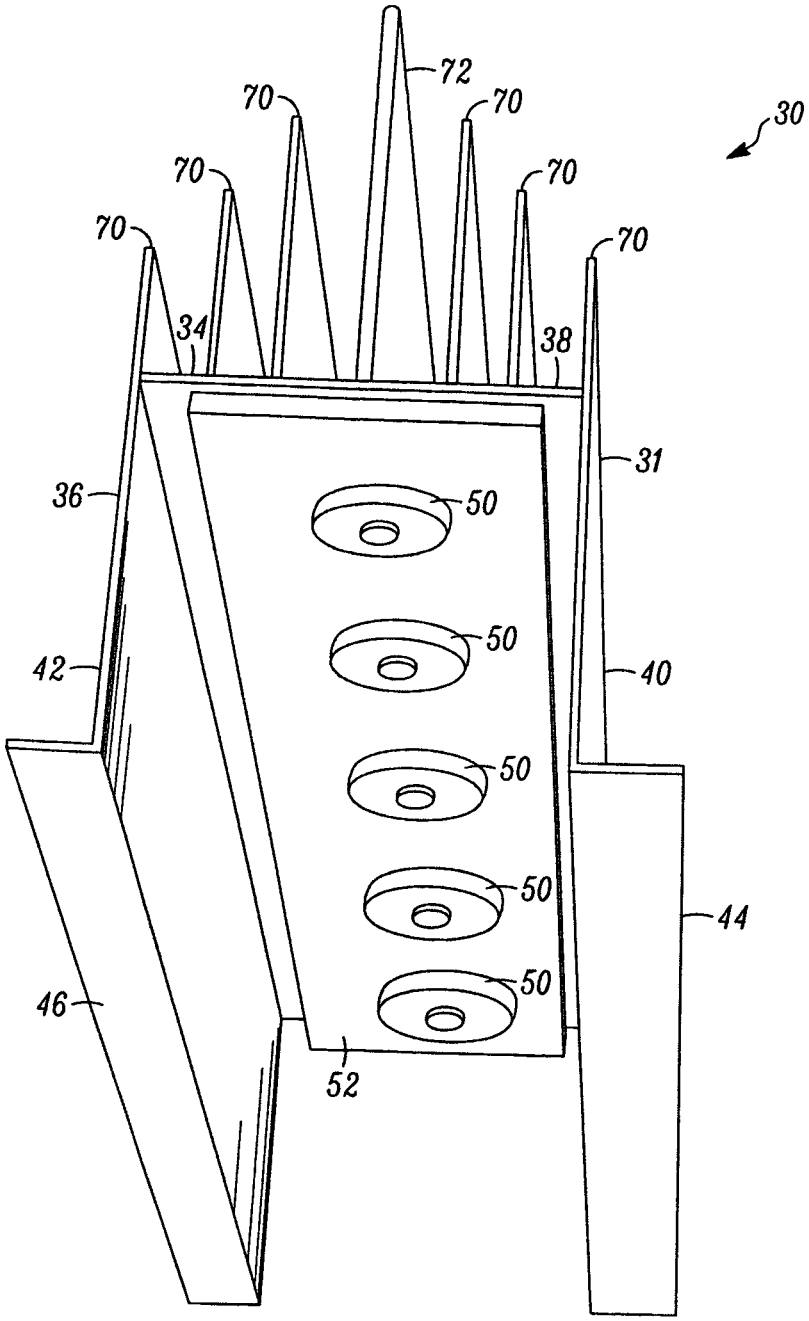
FIG. 3 is a bottom perspective view of a lighting fixture according to the principles of the present invention.
Figure 15:
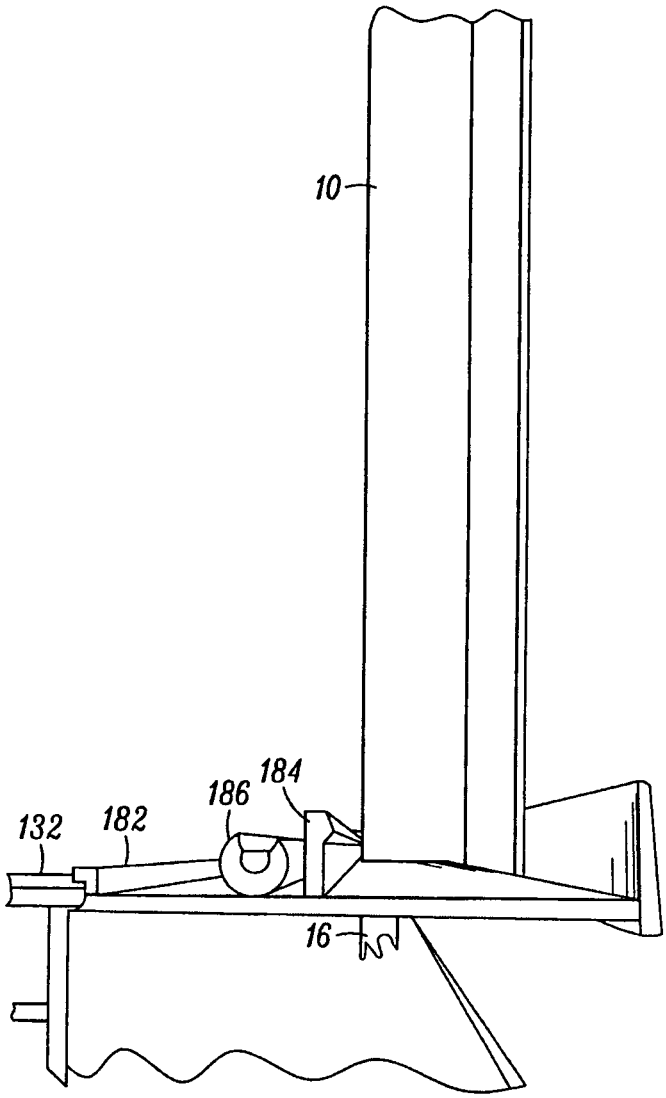
FIG. 15 illustrates the connection of a conventional ceiling mounting grid T-bar to a lighting fixture of the present invention.

Referring now to the drawing, there is illustrated in FIGS. 1 and 2 a typical T bar grid support 10 of the type often used in ceiling grid arrays. The T bar grid support has an upright body member 12 and pair of side flanges 14. A connector portion 16, shown schematically in FIG. 1 and in detail in FIG. 15, extend from each of the ends of the upright body member 12 and are used to insert into apertures such as aperture 18 in the upright body member 12 of adjacent T bar grid supports extending at right angles. The lower surface 14*a* of the side flanges 14 are visible from the area 20 of the room in which the T bar grid and ceiling is installed. The area 22 above the T bar may be an attic or other open space above the ceiling. Ceiling tiles 24 rest on the upper surface 14*b* of flanges 14. The T bars such as T bar 14 are often aligned in a matrix or grid spaced in 12 inch spacing or multiples of 12 inch spacing. The upright body member 12 is often supplied with apertures 26 to which supporting members (not shown) may be attached for connection to structure (not shown) in the area 22.

The present invention is adapted to be included in a T bar grid having T bars the same or similar to the T bar 10.

Referring now to FIGS. 3 to 7 there is illustrated an embodiment 30 of the present invention generally designated 31. As shown thereon there is a hat shaped mounting bracket 32 having a top portion 34 with an inside surface 36 and an outside surface 38. A pair of side portions 40 and 42 have an upper end 40*a* and 42*a* connected to the top portion 34 and depend from the top portion 34 to a bottom edge 40*b* and 42*b*. The side portions 40 are in a first preselected width spaced relationship indicated by W on FIG. 4. The dimension W may be in the range of ⅛th inch to 3 inches though larger dimensions may be used for particular applications. The lighting fixture 32 may have a preselected longitudinal length L (FIG. 5) of 12 inches though length L may be from, for example 2 to 144 inches, or longer if desired, depending upon the requirements of a particular application.

Figure 4:
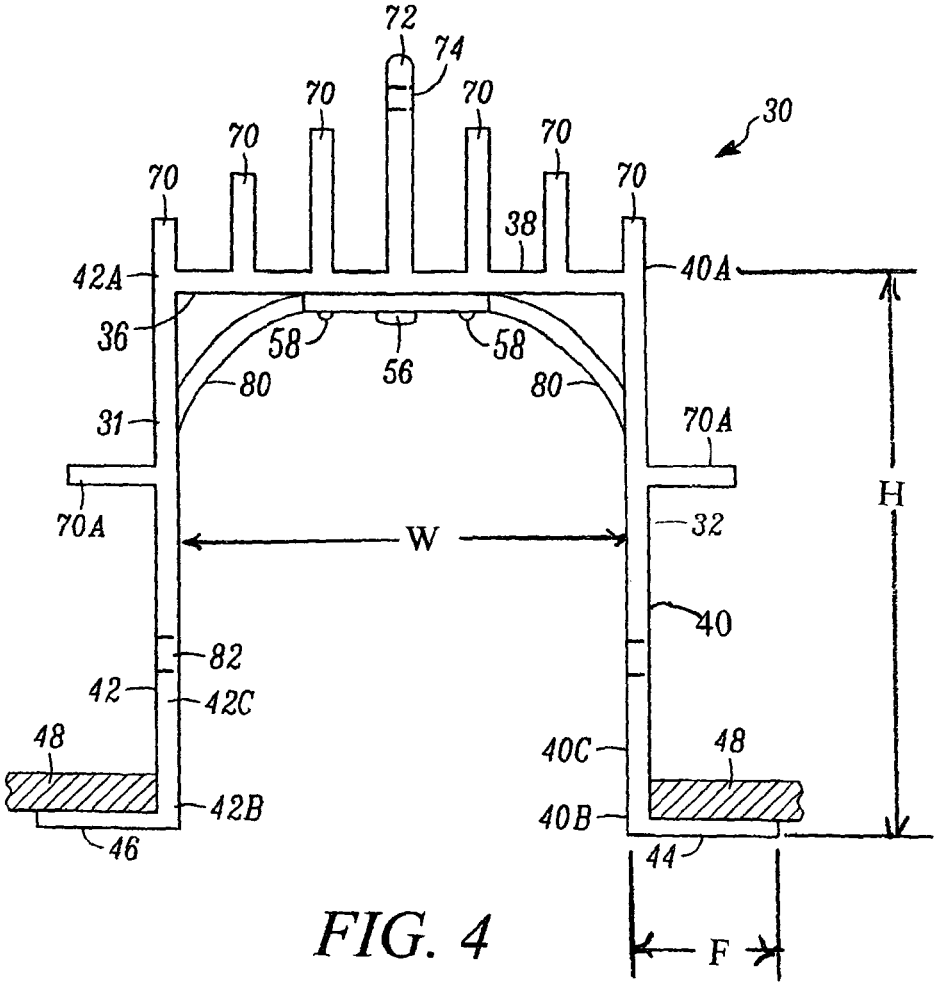
FIG. 4 is an end view of a lighting fixture according to the principles of the present invention.
Figure 5:
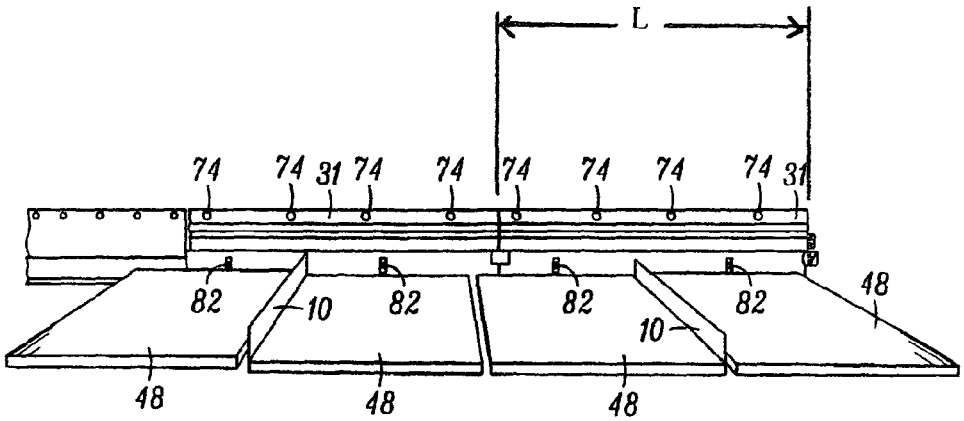
FIG. 5 is a side perspective view of a lighting fixture according to the principles of the present invention showing the installation in a ceiling grid.
Figure 6:
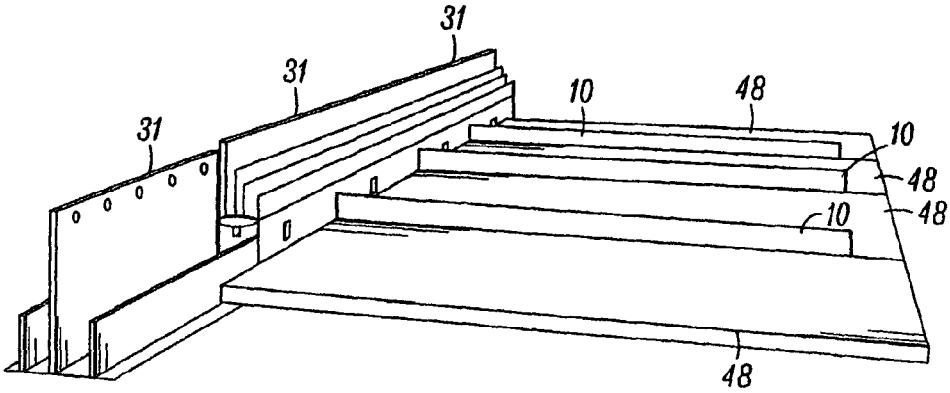
FIG. 6 is front perspective view of a lighting fixture according to the principles of the present invention showing the installation in a ceiling grid.
Figure 7:
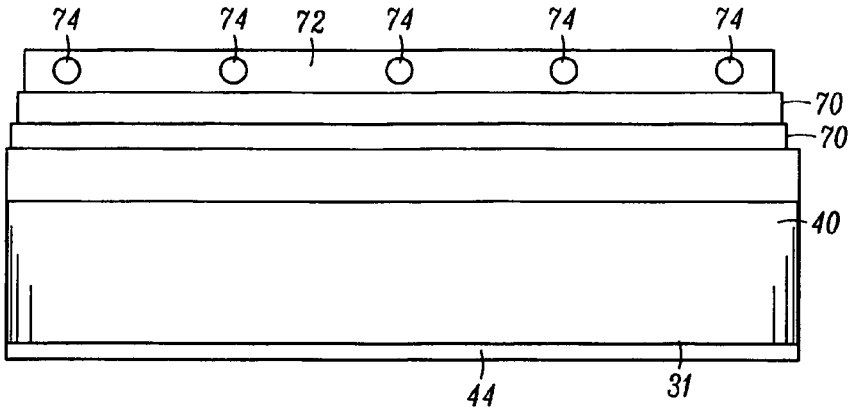
FIG. 7 is a side view of a lighting fixture according to the principles of the present invention.

The side portions 40 and 42 extend a first preselected distance H from the top portion 34 as shown on FIG. 4 and the first preselected distance H may be on the order of 2 inches though a larger or smaller distance may used as desired for particular applications.

A pair of flanges 44 and 46 are provided and flange 44 extends outwardly from the bottom end 40*b* of side portion 40 a second preselected distance indicated on FIG. 4 by F. F may be on the order of ⅛th inch to 1 inch. Flange 46 extends the same distance F from the bottom end 42*b* of side portion 42 though in some applications the flanges 44 and 46 may extend outwardly different distances. Ceiling tiles 48 may rest on the flanges 44 and 46, respectively.

A plurality of LED assemblies 50 are provided on a mounting block 52 that is coupled to the inside surface 36 of top portion 34 of the hat shaped mounting bracket 32. In some embodiments of the present invention the LED assemblies may be mounted directly on the inside surface 36, as shown on FIG. 4 and the mounting block 32 eliminated. The mounting block 52 may, if desired have a reflective inner surface 52*a*. Each of the LED assemblies has an LED 56 therein for emitting light indicated by the arrows 60 generally in the direction of the area 20. Electrically conductive wires 58 connect each of the LED assemblies in parallel.

One or more cooling fins 70 are coupled to the outer surface 38 of the top portion 34 of the hat shaped mounting bracket 32. In preferred embodiments of the present invention, the cooling fin 72, which is centrally located on the top portion 34 of hat shaped mounting bracket 32 may be provided with apertures 74. The apertures 74 may be utilized to allow connection of the lighting fixture 31 to supporting structure (not shown) in the area 22.

In order to direct more light 60 into the desired area 20, some embodiments of the present invention may be provided with a reflector 80 in the space between the inner wall surfaces 40*c* and 42*c* of the side portions 40 and 42 and the inner surface 36 of the top portion 34 of the hat shaped mounting bracket 32. If desired, cooling fins 70*a* may be coupled to the side wall portions 40 and 42 to aid in the dissipation of heat into the area 22.

Apertures 82 may be provided in side wall portions 40 and 42 to receive the connector portions 16 (FIG. 1, 15) of conventional ceiling mounting grid T bar members in the grid in which the lighting fixture 31 is mounted.

Figure 8:
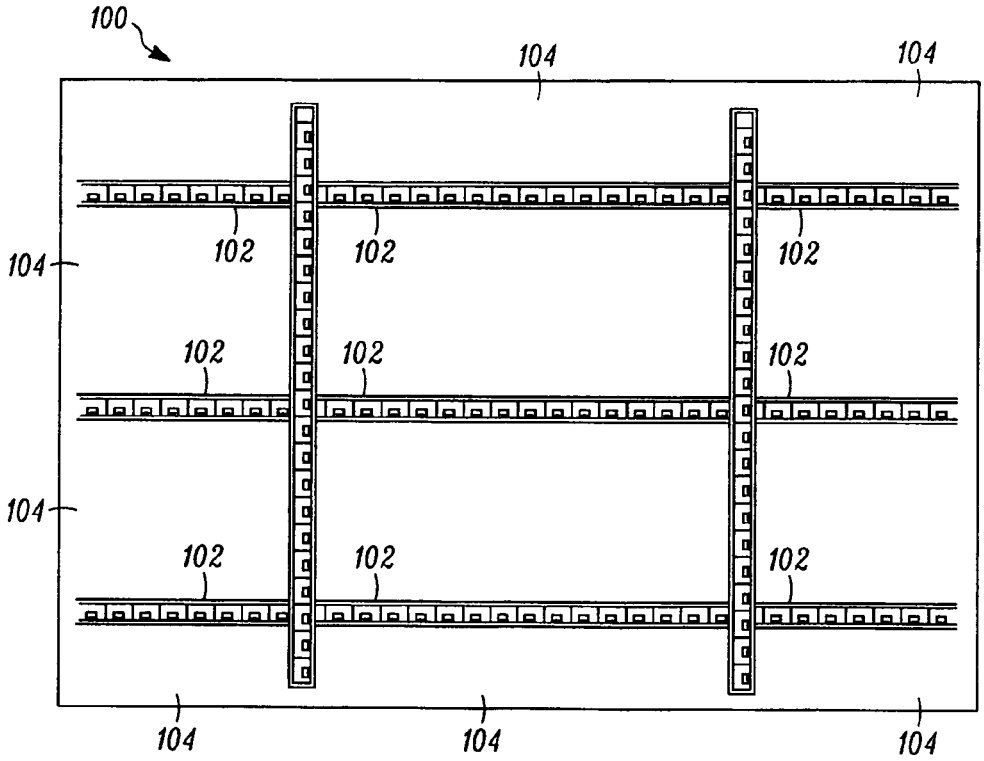
FIG. 8 is a partial sectional view of a ceiling grid looking up at the ceiling in which the lighting fixture of the present invention forms the complete ceiling grid.

FIG. 8 is a partial sectional view of a ceiling, generally designated 100, looking upwardly at the ceiling. In the ceiling 100, there are a plurality of lighting fixtures 102 according to the principles of the present invention arranged in a rectilinear array throughout the ceiling 100. Ceiling tiles 104 rest on the flanges of the mounting bracket of the lighting fixtures 102, as described above in connection with FIG. 4 and below in greater detail in connection with FIG. 10 The lighting fixtures 102 may be standard length corresponding to the length of the T bars or they may be shorter or longer. The tiles 104 may be cut to fit the spacing between the lighting fixtures 102 as required in particular applications.

Figure 9:
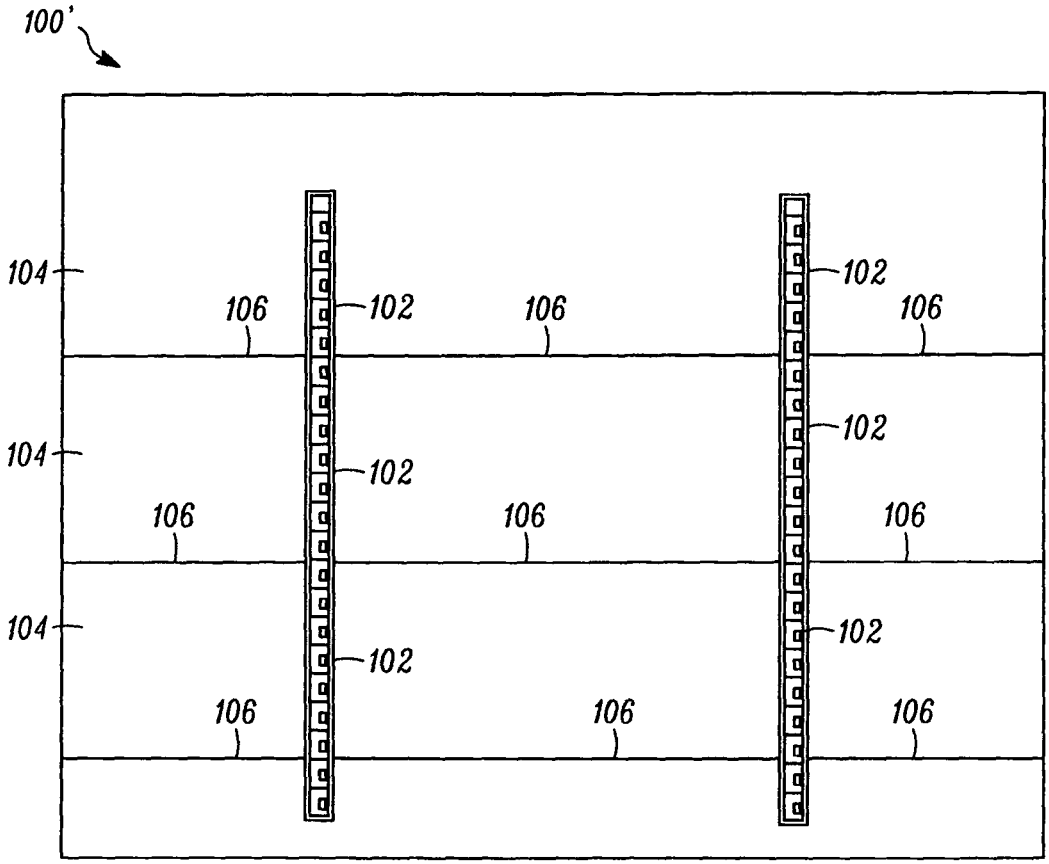
FIG. 9 is a partial sectional view of a ceiling grid looking up at the ceiling in which the lighting fixture of the present invention forms a portion of the ceiling grid.

FIG. 9 is a partial sectional view of a ceiling, generally designated 100', looking upwardly at the ceiling. In the ceiling 100', there are a plurality of lighting fixtures 102 according to the principles of the present invention arranged in a parallel linear array. As in the ceiling 100 of FIG. 8, conventional ceiling tiles 104 may rest on the T grid supports 106. The lighting fixture of the present invention may be used in any ceiling in any spaced apart linear arrays so that light may be directed to any desired location. If other than a linear is required, the ceiling tiles 104 may be cut to match the array.

Figure 10:
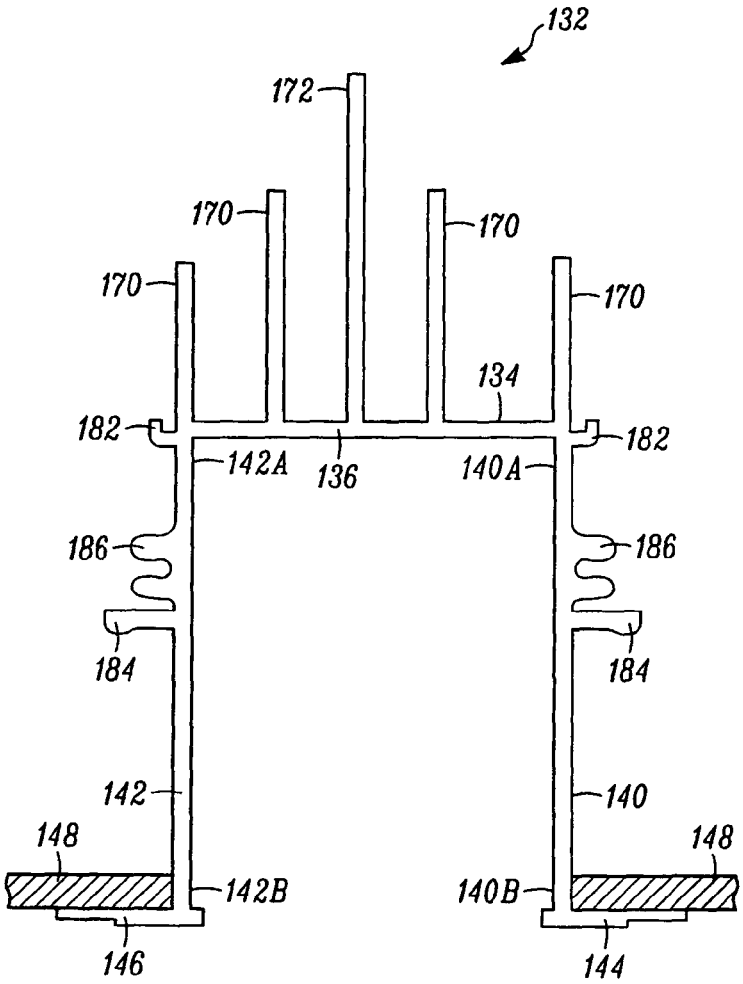
FIG. 10 is an end view of another embodiment of a mounting bracket useful in the practice of the present invention.

FIG. 10 is an end view of modified hat shaped mounting bracket similar to mounting bracket 32 described above useful in a LED lighting fixture of the present invention. As shown thereon, the mounting bracket 132 has a top portion 134 with an inside surface 136 and an outside surface 138. A pair of side portions 140 and 142 have an upper end 140*a* and 142*a* connected to the top portion 134 and depend from the top portion 134 to a bottom edge 140*b* and 142*b*. The side portions 140 and 142 are in a first preselected width spaced relationship indicated by W' on FIG. 10. The dimension W' may be in the range of ⅛th inch to 3 inches though larger dimensions may be used for particular applications. The side portions 140 and 142 extend a first preselected distance H' from the top portion 134 as shown on FIG. 10 and the first preselected distance H' may be on the order of 2 inches though a larger or smaller distance may used as desired for particular applications.

A pair of flanges 144 and 146 are provided and flange 144 extends outwardly from the bottom end 140*b* of side portion 140 a second preselected distance indicated on FIG. 10 by F'. F' may be on the order of ⅛th inch to ½ inch. Flange 146 extends the same distance F' from the bottom end 142*b* of side portion 142 though in some applications the flanges 144 and 146 may extend outwardly different distances. The flanges 144 and 146 extend the entire longitudinal length of the mounting bracket 134 in the preferred embodiments of the present invention. Ceiling tiles 148 may rest on the flanges 144 and 146, respectively.

One or more cooling fins 170 are coupled to the outer surface 138 of the top portion 134 of the hat shaped mounting bracket 132. As discussed below, in preferred embodiments of the present invention, the cooling fin 172, which may be centrally located on the top portion 134 of hat shaped mounting bracket 132 may be provided with apertures 174 which may be utilized to allow connection of the lighting fixture 131 to supporting structure.

The hat shaped mounting bracket 132 is provided with top clip accepting shoulder member 182 and bottom clip accepting shoulder member 184 which extend longitudinally along the length of side portions 140 and 142 which, as discussed below, are utilized in conjunction with a clip to removably connect together adjacent hat shaped mounting brackets 132 in an aligned linear arrangement. Screw accepting members 186 also are coupled to each of the side members 140 and 142 and extend longitudinally along the length of the side members 140 and 142.

Figure 11:
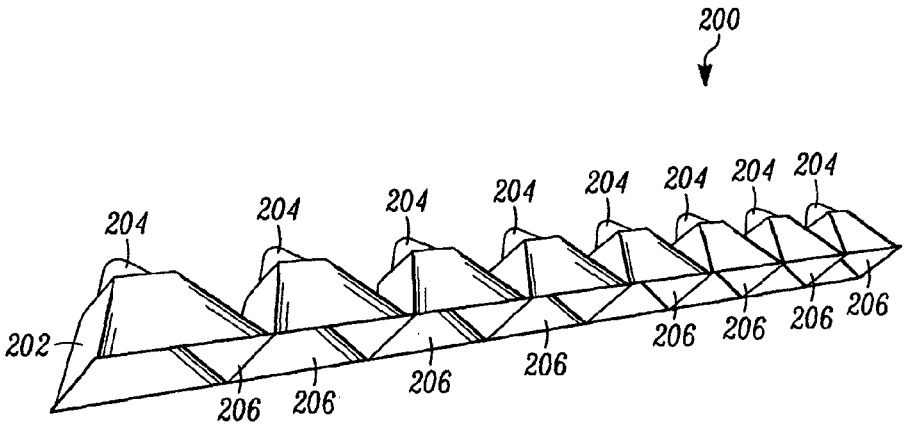
FIGS. 11 and 12 illustrate another embodiment of an LED lighting assembly according to the principles of the present invention.
Figure 12:
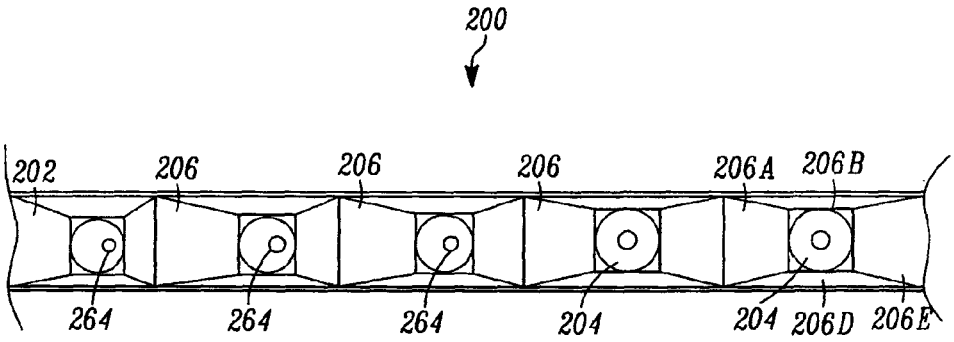

FIGS. 11 and 12 illustrate another embodiment, generally designated 200, of a LED lighting assembly 202 useful in the practice of the present invention. As shown on FIGS. 11 and 12, each of the LED's 204 are provided with a reflector 206 to direct the light emitted from the LED's into a selected light path. The reflectors 206 are shown on FIGS. 11 and 12 as comprised of flat, planar members 206*a*, 206*b*, 206*c* and 206*d*. The reflectors may be shaped of other geometric members as may be desired for particular applications to direct the light emitted from the LED's into any desired light path.

Figure 13:
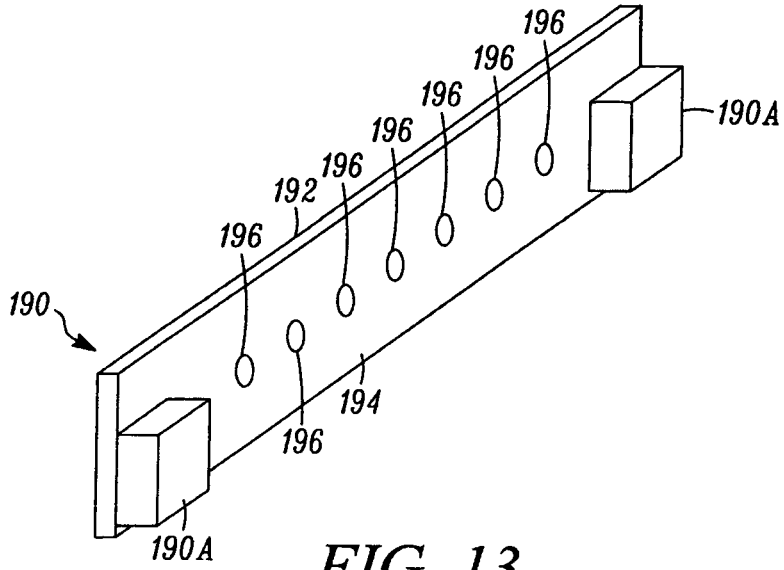
FIG. 13 illustrates a schematic representation of circuit board useful in the practice of the present invention.

FIG. 13 is a semi-schematic perspective view of a circuit board 190 which contains the electrical connections for each of the LED's and the end terminals 190*a* for connection to and electrical power source. The circuit board 190 has an upper surface 192 which may be coupled to the inside surface 136 of hat shaped mounting bracket 132. The coupling of the circuit board 192 to the inside surface 136 of hat shaped mounting bracket 132 may be by adhesives, screws, or any other desired coupling arrangement. The circuit board 190 also has a lower surface 194 to which a LED lighting assembly such as the LED lighting assembly 202 described above may be coupled with the connection tips 204*a* of LED's 204 projecting into the apertures 196 of the circuit board 190. The assembly of the circuit board 190, the lighting assembly 202 and the hat shaped mounting bracket comprise the LED lighting fixture 220 of the present invention.

Figure 14:
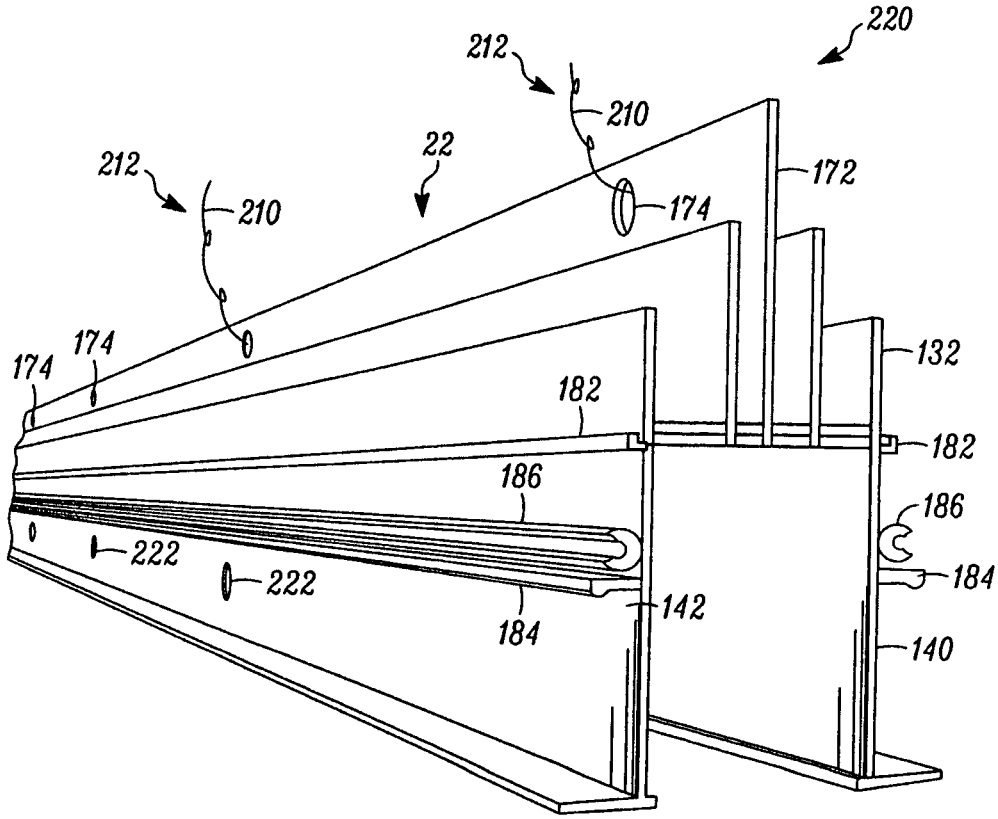
FIG. 14 is a perspective view of the mounting bracket of FIG. 10 with the circuit board and LED lighting assembly omitted for clarity.

FIG. 14 is a perspective view of the hat shaped mounting bracket 132 and in which the circuit board 190, the LED lighting assembly 202 and ceiling tiles 148 have been omitted for clarity. Wires 210 or other similar materials provide a coupling configuration 212 and may be connected to the apertures 174 in cooling fin 172 and to such structure (not shown) thereabove in the volume 22 above as may be available to support the complete LED lighting fixture 220. The side portions 140 and 142 of hat shaped mounting bracket 132 may be provided with apertures 222 for receiving the connecters of a T bar grid support such as the T bar grid support of FIGS. 1 and 2.

Figure 16:
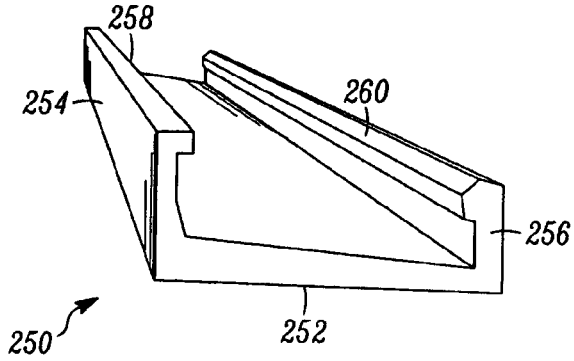
FIG. 16 illustrates a clip useful in connecting together LED lighting fixtures of present invention.

FIG. 16 illustrates a clip 250 useful in the practice of the present invention. As shown thereon there is a clip side member 252 and a clip top member 254 connected thereto and a clip bottom member 256 connected thereto. The clip top member 254 and the clip bottom member 256 extend outwardly from the clip side member 252. The clip top member 254 has a clip top mating portion 258 and the clip bottom member 256 has a clip bottom mating portion 260. The clip top mating portion 258 fits into the top clip accepting portion 182 of the hat shaped mounting bracket 132 and the clip bottom mating portion 260 fits into the bottom clip accepting portion 184 of the hat shaped mounting bracket 132.

Figure 17:
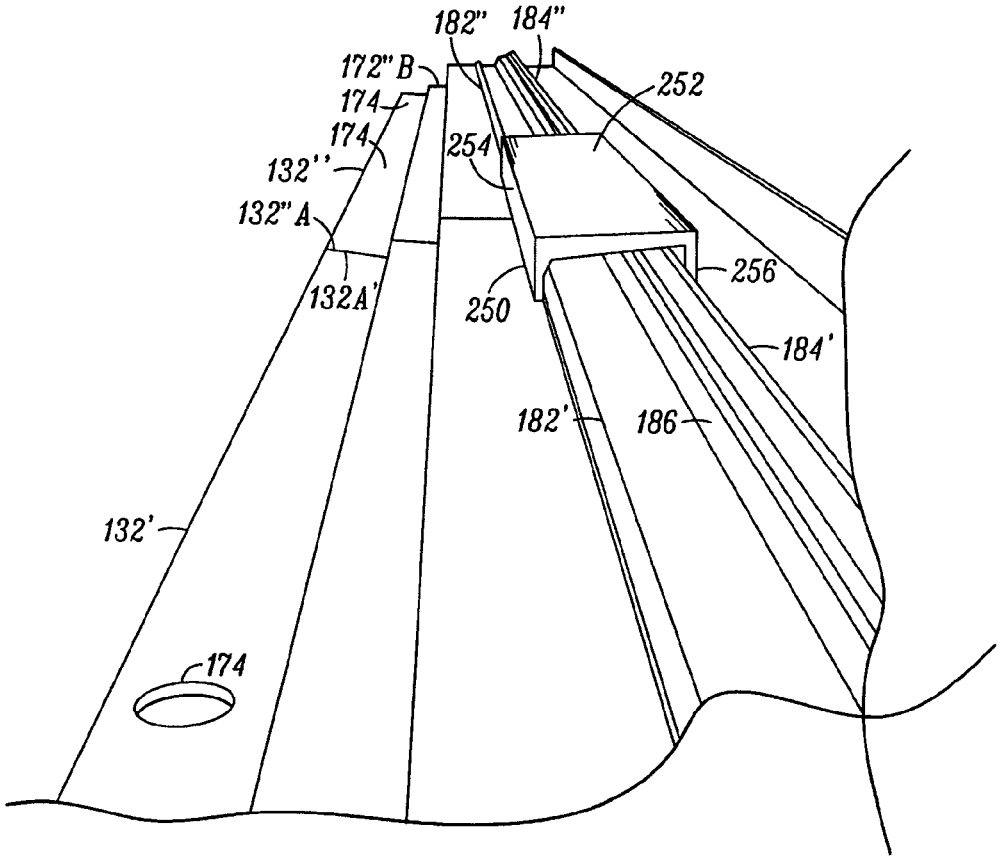
FIG. 17 illustrates the clip of FIG. 16 connecting together two lighting fixtures of the present invention in a linear array.

FIG. 17 shows a first LED lighting fixture 132' and second LED lighting fixture 132" connected together in an aligned linear array by a clip 250. The clip 250 is connected to the top clip accepting member 182' of the hat shaped mounting bracket 132' and to the bottom clip accepting member 184' of the hat shaped mounting bracket 132' in regions adjacent the end 132'*a* of hat shaped mounting bracket 132' as described above. In order to connect the two lighting fixtures 132' and 132" in aligned linear array such as, for example, the array shown on FIG. 9, the clip 250 is also connected to the top clip accepting member 182" of the hat shaped mounting bracket 132" and to the bottom clip accepting member 184" of the hat shaped mounting bracket 132" in regions adjacent the end 132"*a* of hat shaped mounting bracket 132"*a* as described above. The ends 132'*a* and 132"*a* abut each other as shown on FIG. 17.

Figure 18:
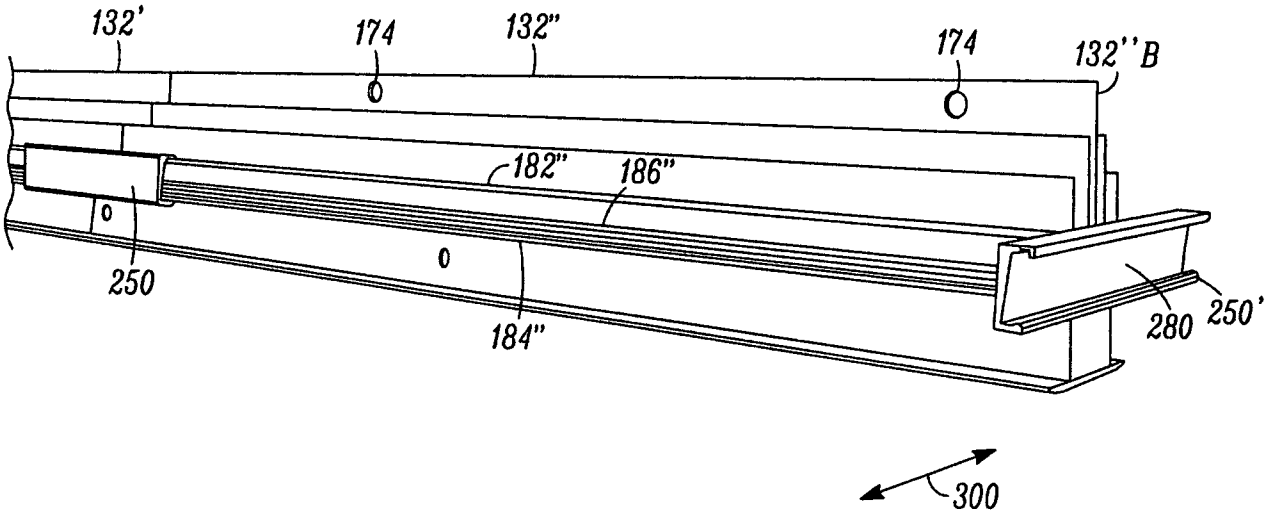
FIG. 18 illustrates the clip of FIG. 16 connecting together two lighting fixtures of the present invention in a linear array and a clip in position to connect lighting fixtures of the present invention in a T configuration.

In order to connect a LED lighting fixture of the present invention to, for example the end 132"*b* of lighting fixture 132" shown on FIG. 17, and extending a right angles thereto as illustrated in FIG. 8 the clip 250 may also be utilized. FIG. 18 illustrates such a connection. As shown thereon, the LED lighting fixtures 132' and 132" are connected as shown on FIG. 17. The end 132"*b* of LED lighting fixture 132" is connected to clip 250' which extends transversely thereto. The connection between the clip 250' and the LED lighting fixture 132" is achieved by shown thereon, the LED lighting fixtures 132' and 132" are connected as shown on FIG. 17. The end 132"*b* of LED lighting fixture 132" is connected to clip 250' which extends transversely thereto. The connection between the clip 250' and the LED lighting fixture 132" is achieved by screws 280 extending through the side member 252 of clip 250 and into the screw accepting member 186". As so coupled together, another LED lighting fixture (not shown) may be similarly connected to the clip 250' in the directions indicated by the double ended arrow 300 to provide a connection of LED lighting fixtures as shown on FIG. 8.

Figure 19:
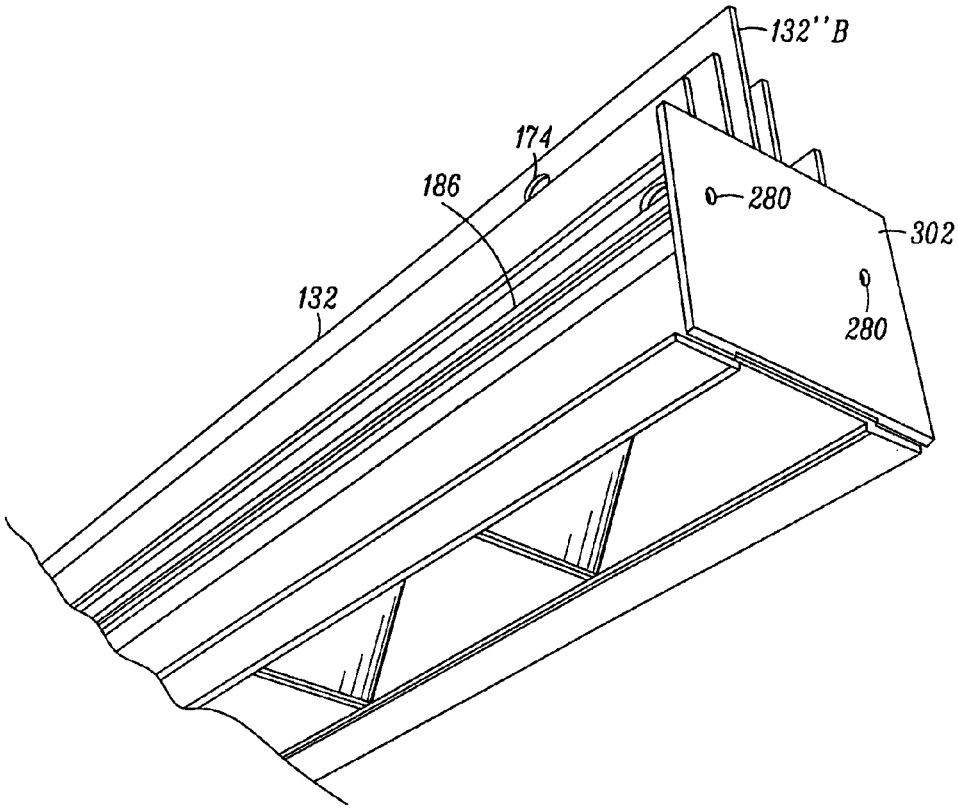
FIG. 19 illustrates the use of an end cap useful in the practice of the present invention; and, FIG. 20 illustrates a modified hat shaped mounting bracket useful in the practice of the present invention.

In some applications of the present invention it may be desirable to cover the end, such as end 132'*b* of LED lighting fixture 132". FIG. 19 illustrates an end plate 302 coupled to the hat shaped mounting bracket 132 of a LED lighting fixture 320 according to the principles of the present invention. A pair of screws 280 extend through the end plate 302 and into the screw accepting aperture 186 of hat shaped mounting bracket 132.

Figure 20:
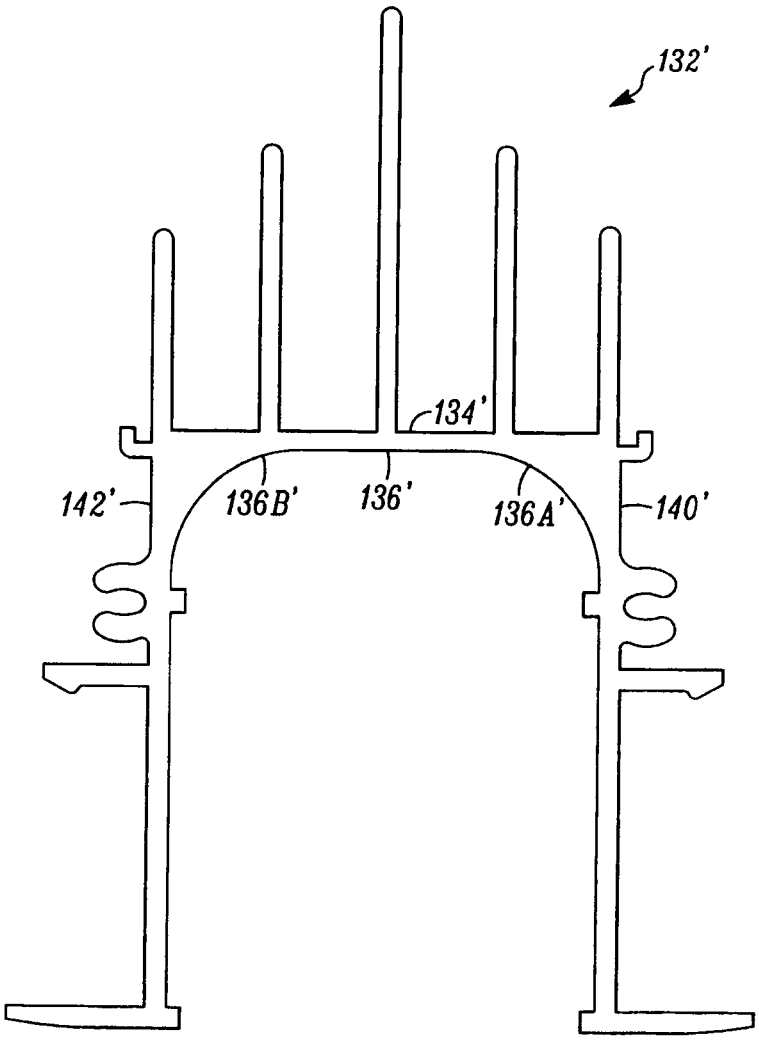

Referring now to FIG. 20, there is shown a slightly modified configuration, designated 132', of the hat shaped mounting brackets 132 and 32 described above. As shown, the hat shaped mounting bracket 132' has an inside surface 136' of the top portion 134'. The corners 136'*a* and 136'*b*, at the intersection with the side portions 140' and 142' are arcuate in shape rather than at right angles thereto as shown for hat shaped mounting brackets 32 and 132.

Although specific embodiments of the present invention have been described above with reference to the various Figures of the drawing, it should be understood that such embodiments are by way of example only and merely illustrative of but a small number of the many possible specific embodiments which can represent applications of the principles of the present invention.

What is claimed is:

1. A ceiling mounted lighting fixture comprising, in combination:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

at least one of said side portions having walls defining a T bar grid mounting portion accepting aperture extending therethrough;

a pair of flange portions, one flange portion connected to each of said side portions at the bottom edges thereof and extending outwardly a second preselected distance therefrom;

a plurality of LED's connected to said inside surface of said top portion of said hat shaped mounting bracket;

whereby the lighting fixture is supported in said T bar grid by the interconnection of the T bar grid connector portions inserted in said apertures in said side portions of said hat shaped mounting bracket.

2. The arrangement defined in claim 1 and further comprising:

electrically conductive wires connected to said LED's for providing electrical energy thereto.

3. The arrangement defined in claim 1 and further comprising:

at least one cooling fin connected to said outside surface of said top surface of said hat shaped mounting bracket for dissipating heat generated by operation of said LED's.

4. The arrangement defined in claim 2 and further comprising:

a plurality of cooling fins coupled to said outside surface of said top portion of said hat shaped mounting bracket for dissipating heat generated by operation of said LED's.

5. The arrangement defined in claim 2 and wherein:

said electrically conductive wires connected said LED's in parallel.

6. The arrangement defined in claim 1 and further comprising:

a light reflector connected to said hat shaped mounting bracket in regions adjacent said inside surface for directing light downwardly from said hat shaped mounting bracket.

7. The arrangement defined in claim 6 and further comprising:

electrically conductive wires connected to said LED's for providing electrical energy thereto and connecting said LED's in parallel.

8. The arrangement defined in claim 7 and further comprising:

at least one cooling fin connected to said outer surface of said upper portion of said hat shaped mounting bracket for dissipating heat generated by operation of said LED's.

9. The arrangement defined in claim 8 and further comprising:

a plurality of cooling fins connected to said outer surface of said upper portion of said hat shaped mounting bracket for dissipating heat generated by operation of said LED's.

10. The arrangement defined in claim 9 wherein:

said preselected width is in the range of about one eighth inch to three inches;

said preselected length is in the range of 2 inches to 144 inches.

11. The arrangement defined in claim 10 wherein:

said first preselected distance is on the order of two inches;

said second preselected distance is in the range of ⅛th inch to 1 inch.

12. The arrangement defined in claim 9 wherein:

said preselected width is in the range of about one inch to three inches;

said preselected length is an even multiple of about twelve inches.

13. A ceiling mounted lighting fixture comprising, in combination:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

a pair of flange portions, one flange portion connected to each of said side portions at the bottom edges thereof and extending outwardly a second preselected distance therefrom;

a pair of top clip accepting shoulder members, one top clip accepting shoulder member coupled to each of said pair of side members on regions adjacent said top portion and extending outwardly therefrom a first clip distance;

a pair of bottom clip accepting shoulder members, one bottom clip accepting shoulder member coupled to each of said pair of side members in spaced relationship to said top clip accepting shoulder members and extending outwardly from said side members a second clip distance;

a LED lighting assembly connected to said inside surface of said top portion of said hat shaped mounting bracket.

14. The arrangement defined in claim 13 and further comprising:

a pair of screw accepting members, one screw accepting member coupled to each of said pair of side members intermediate said top clip accepting shoulder member and said bottom clip accepting shoulder member and extending outwardly from said side members.

15. The arrangement defined in claim 13 wherein:

said LED lighting assembly comprises:

a plurality of LED's in spaced relationship;

light reflector members adjacent each of said plurality of LED's for directing light emitted from said LED's in a preselected path.

16. A ceiling mounted lighting fixture array comprising, in combination:

a plurality of LED lighting fixtures in a predetermined array, each of said LED lighting fixtures comprising:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

a pair of flange portions, one flange portion connected to each of said side portions at the bottom edges thereof and extending outwardly a second preselected distance therefrom;

a pair of top clip accepting shoulder members, one top clip accepting shoulder member coupled to each of said pair of side members on regions adjacent said top portion and extending outwardly therefrom a first clip distance;

a pair of bottom clip accepting shoulder members, one bottom clip accepting shoulder member coupled to each of said pair of side members in spaced relationship to said top clip accepting shoulder members and extending outwardly from said side members a second clip distance;

a pair of screw accepting members, one screw accepting member coupled to each of said pair of side members intermediate said top clip accepting shoulder member and said bottom clip accepting shoulder member and extending outwardly from said side members;

a LED lighting assembly connected to said inside surface of said top portion of said hat shaped mounting bracket, each of said LED lighting assemblies comprising;

a plurality of LED's in spaced relationship;

light reflector members adjacent each of said plurality of LED's for directing light emitted from said LED's in a preselected path.

17. The arrangement defined in claim 16 wherein:

at least two of said plurality of LED lighting fixture are in a linear array and each of said plurality of LED lighting fixtures having spaced apart end surfaces and wherein one of said end surfaces of a first of said pair of LED lighting fixtures abuts one of said end surfaces of said second of said pair of LED lighting fixtures;

and further comprising:

a clip having a clip top member and a clip bottom member;

said clip top member detachably engaging said top clip accepting shoulder members of each of said at least two of said plurality of LED lighting fixtures;

said clip bottom member detachably engaging said bottom clip accepting shoulder members of each of said at least two of said plurality of LED lighting fixtures; whereby said pair of LED lighting fixtures are maintained in said linear array.

18. The arrangement defined in claim 16 wherein:

at least two of said plurality of LED lighting fixture are in a perpendicular array and each of said plurality of LED lighting fixtures having spaced apart end surfaces and wherein one of said end surfaces of a first of said pair of LED lighting fixtures is adjacent one of said side surfaces of said second of said LED lighting fixtures intermediate said spaced apart end surfaces of said second of said pair of LED lighting fixtures;

and further comprising:

a clip having a clip top member and a clip bottom member;

said clip top member detachably engaging said top clip accepting shoulder members of said second of least two of said plurality of LED lighting fixtures;

said clip bottom member detachably engaging said bottom clip accepting shoulder members said second of said plurality of LED lighting fixtures;

said clip having a clip side member joining said clip top member and said clip bottom member, and said clip side member having spaced apart apertures therethrough screws extending through said spaced apart aperture and engaging said screw accepting members on said second of said plurality of LED lighting fixtures, whereby said pair of lighting fixtures are maintained in said perpendicular array.

19. The arrangement defined in claim 13 and further comprising:

said hat shaped mounting bracket having a pair of spaced apart end surfaces;

an end plate abutting one of said pair of spaced apart end surfaces of said hat shaped mounting bracket, said end plate having a pair of spaced apart apertures extending therethrough;

a pair of screws extending through said apertures in said end plate and said screws engaging said screw accepting members on said side members of said hat shaped mounting bracket.

20. The arrangement defined in claim 13 wherein:

said inside surface of said top portion of said hat shaped mounting bracket has arcuate sections at the intersection of said top portion and said side portions.

21. A ceiling mounted lighting fixture for mounting in a ceiling mounted T bar grid of the type having connector portions extending therefrom comprising, in combination:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

each of said side portions having walls defining a T bar grid connector portions accepting aperture extending therethrough;

a pair of flange portions, one flange portion connected to each of said side portions at the bottom edges thereof and extending outwardly a second preselected distance therefrom;

a plurality of LED's connected to said inside surface of said top portion of said hat shaped mounting bracket;

whereby, the lighting fixture is supported in the T bar grid by the interconnection of the T-bar grid connector portions inserted in said apertures in said side portions of said hat shaped mounting bracket.

22. A ceiling mounted lighting fixture for mounting in a ceiling mounted T bar grid of the type having connector portions extending therefrom comprising, in combination:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

each of said side portions having walls defining a T bar grid connector portions accepting aperture extending therethrough;

a pair of flange portions, one flange portion connected to each of said side portions at the bottom edges thereof and extending outwardly a second preselected distance therefrom;

a pair of top clip accepting shoulder members, one top clip accepting shoulder member coupled to each of said pair of side members on regions adjacent said top portion and extending outwardly therefrom a first clip distance;

a pair of bottom clip accepting shoulder members, one bottom clip accepting shoulder member coupled to each of said pair of side members in spaced relationship to said top clip accepting shoulder members and extending outwardly from said side members a second clip distance;

a LED lighting assembly connected to said inside surface of said top portion of said hat shaped mounting bracket;

whereby, the lighting fixture is supported in the T bar grid by the interconnection of the T-bar grid connector portions inserted in said apertures in said side portions of said hat shaped mounting bracket.

23. The arrangement defined in claim 21 wherein:

said T bar grid connector portions accepting apertures are intermediate said top edge and said bottom edge of said side portions of said hat shaped mounting bracket.

24. The arrangement defined in claim 23 and further comprising:

a pair of screw accepting members, one screw accepting member coupled to each of said pair of side members intermediate said top clip accepting shoulder member and said bottom clip accepting shoulder member and extending outwardly from said side members.

25. The arrangement defined in claim 23 wherein:

said LED lighting assembly comprises:

a plurality of LED's in spaced relationship;

light reflector members adjacent each of said plurality of LED's for directing light emitted from said LED's in a preselected path.

26. The arrangement defined in claim 23 and further comprising:

said hat shaped mounting bracket having a pair of spaced apart end surfaces;

an end plate abutting one of said pair of spaced apart end surfaces of said hat shaped mounting bracket, said end plate having a pair of spaced apart apertures extending therethrough;

a pair of screws extending through said apertures in said end plate and said screws engaging said screw accepting members on said side members of said hat shaped mounting bracket.

27. The arrangement defined in claim 23 wherein:

said inside surface of said top portion of said hat shaped mounting bracket has arcuate sections at the intersection of said top portion and said side portions.

28. A ceiling mounted lighting fixture for mounting in a ceiling mounted T bar grid of the type having connector portions extending therefrom comprising, in combination a plurality of LED lighting fixtures in a predetermined array, each of said LED lighting fixtures comprising:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

each of said side portions having walls defining a T bar grid connector portions accepting aperture extending therethrough;

a pair of flange portions, one flange portion connected to each of said side portions at the bottom edges thereof and extending outwardly a second preselected distance therefrom;

a pair of top clip accepting shoulder members, one top clip accepting shoulder member coupled to each of said pair of side members on regions adjacent said top portion and extending outwardly therefrom a first clip distance;

a pair of bottom clip accepting shoulder members, one bottom clip accepting shoulder member coupled to each of said pair of side members in spaced relationship to said top clip accepting shoulder members and extending outwardly from said side members a second clip distance;

a pair of screw accepting members, one screw accepting member coupled to each of said pair of side members intermediate said top clip accepting shoulder member and said bottom clip accepting shoulder member and extending outwardly from said side members;

a LED lighting assembly connected to said inside surface of said top portion of said hat shaped mounting bracket, each of said LED lighting assemblies comprising;

a plurality of LED's in spaced relationship;

light reflector members adjacent each of said plurality of LED's for directing light emitted from said LED's in a preselected path;

whereby, the lighting fixture is supported in the T bar grid by the interconnection of the T-bar grid connector portions inserted in said apertures in said side portions of said hat shaped mounting bracket.

29. The arrangement defined in claim 28 wherein:

at least two of said plurality of LED lighting fixture are in a linear array and each of said plurality of LED lighting fixtures having spaced apart end surfaces and wherein one of said end surfaces of a first of said pair of LED lighting fixtures abuts one of said end surfaces of said second of said pair of LED lighting fixtures;

and further comprising:

a clip having a clip top member and a clip bottom member;

said clip top member detachably engaging said top clip accepting shoulder members of each of said at least two of said plurality of LED lighting fixtures;

said clip bottom member detachably engaging said bottom clip accepting shoulder members of each of said at least two of said plurality of LED lighting fixtures;

whereby said pair of LED lighting fixtures are maintained in said linear array.

30. The arrangement defined in claim 28 wherein:

at least two of said plurality of LED lighting fixture are in a perpendicular array and each of said plurality of LED lighting fixtures having spaced apart end surfaces and wherein one of said end surfaces of a first of said pair of LED lighting fixtures is adjacent one of said side surfaces of said second of said LED lighting fixtures intermediate said spaced apart end surfaces of said second of said pair of LED lighting fixtures;

and further comprising:

a clip having a clip top member and a clip bottom member;

said clip top member detachably engaging said top clip accepting shoulder members of said second of least two of said plurality of LED lighting fixtures;

said clip bottom member detachably engaging said bottom clip accepting shoulder members said second of said plurality of LED lighting fixtures;

said clip having a clip side member joining said clip top member and said clip bottom member, and said clip side member having spaced apart apertures therethrough screws extending through said spaced apart aperture and engaging said screw accepting members on said second of said plurality of LED lighting fixtures, whereby said pair of lighting fixtures are maintained in said perpendicular array.

31. The arrangement defined in claim 28 and further comprising:

said hat shaped mounting bracket having a pair of spaced apart end surfaces;

an end plate abutting one of said pair of spaced apart end surfaces of said hat shaped mounting bracket, said end plate having a pair of spaced apart apertures extending therethrough;

a pair of screws extending through said apertures in said end plate and said screws engaging said screw accepting members on said side members of said hat shaped mounting bracket.

32. The arrangement defined in claim 23 wherein:

said inside surface of said top portion of said hat shaped mounting bracket has arcuate sections at the intersection of said top portion and said side portions.

33. A ceiling mounted lighting fixture arrangement comprising, in combination:

a plurality of lighting fixtures, each of said lighting fixture having:

a hat shaped mounting bracket having:

a top portion having an inside surface and an outside surface and having a preselected width and a preselected length;

at least one cooling fin mounted on said top portion and having walls defining a supporting member accepting aperture therein;

a pair of side portions depending from said top portion and having an upper edge at said top portion and a bottom edge spaced a first preselected distance from said top portion;

at least one of said side portions having walls defining a T bar grid connecting portion accepting aperture extending therethrough;

a pair of flange portions, one flange portion connected to each of said side portions at the bottom edges thereof and extending outwardly a second preselected distance therefrom;

a plurality of LED's connected to said inside surface of said top portion of said hat shaped mounting bracket;

a T bar grid, said T bar grid having T bar grid connector portions, at least some of said T bar grid connecting portions operatively connected to said T bar grid connecting portion accepting apertures and extending therethrough;

said lighting fixtures operatively connected to said T bar grid by the interconnection of the T bar grid connector portions inserted in said T bar grid connector portion accepting apertures; and a supporting member in said supporting member accepting apertures in said cooling fin on said top portion of said lighting fixture.

34. A ceiling mounted lighting fixture arrangement comprising, in combination:

a plurality of lighting fixtures, each of said lighting fixture having:

a hat shaped mounting bracket having:

a top portion having an inside surface and an outside surface and having a preselected width and a preselected length;

a pair of side portions depending from said top portion and having an upper edge at said top portion and a bottom edge spaced a first preselected distance from said top portion;

at least one of said side portions having walls defining a T bar grid connector portion accepting aperture extending therethrough;

a pair of flange portions, one flange portion connected to each of said side portions at the bottom edges thereof and extending outwardly a second preselected distance therefrom;

a plurality of LED's connected to said inside surface of said top portion of said hat shaped mounting bracket a T bar grid, said T bar grid having:

T bar grid connector portions, at least some of said T bar grid connecting portions operatively connected to said T bar grid connecting portion accepting apertures and extending therethrough;

walls defining a plurality of support member receiving apertures;

said lighting fixtures operatively connected to said T bar grid by the interconnection of the T bar grid connector portions inserted in said T bar grid connector portion accepting apertures; and a supporting member in said supporting member accepting apertures in said T bar grid.

* * * * *